US008628047B2

(12) United States Patent
Cooper et al.

(10) Patent No.: US 8,628,047 B2
(45) Date of Patent: Jan. 14, 2014

(54) SYSTEM, METHOD AND DEVICE FOR CONVEYING INFORMATION FROM A WAYSIDE DEVICE

(75) Inventors: Jared K. Cooper, Melbourne, FL (US); David Eldredge, Melbourne, FL (US); William Schoonmaker, Melbourne, FL (US); John Brand, Melbourne, FL (US); Frank Wawrzyniak, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 13/182,823

(22) Filed: Jul. 14, 2011

(65) Prior Publication Data

US 2013/0015298 A1 Jan. 17, 2013

(51) Int. Cl.
*B61L 29/24* (2006.01)

(52) U.S. Cl.
USPC ..... 246/473.3

(58) Field of Classification Search
USPC ..... 246/1 R, 1 C, 20–22, 27, 473 R, 473.3, 246/474
See application file for complete search history.

(56) References Cited

U.S. PATENT DOCUMENTS

| | | | | |
|---|---|---|---|---|
| 6,441,750 | B1 | 8/2002 | Hutchison | |
| 7,104,509 | B2 * | 9/2006 | Zander | 246/473 A |

FOREIGN PATENT DOCUMENTS

| | | | |
|---|---|---|---|
| CN | 2413969 | Y | 10/2001 |
| CN | 2466014 | Y | 12/2001 |
| CN | 2786415 | Y | 7/2006 |
| CN | 201023492 | Y | 2/2008 |

* cited by examiner

*Primary Examiner* — R.J. McCarry, Jr.
(74) *Attorney, Agent, or Firm* — GE Global Patent Operation; John A. Kramer

(57) ABSTRACT

A system, method and device for communicating information from a wayside device to a vehicle are provided. In one embodiment, the device comprises. a first light unit configured to emit a first pattern of light in a non-visible spectrum; a second light unit configured to emit a second pattern of light in the non-visible spectrum; wherein said first pattern is distinct from said second pattern; an interface in communication with the first and second light units and configured to receive information of an operational mode of the wayside device; wherein the first and second light units are responsive to one or more first control signals from said interface to operate in a first mode, corresponding to a first operational mode of the wayside device, in which said first pattern of light is on and said second pattern of light is off; and wherein the first and second light units are responsive to one or more second control signals from said interface to operate in a second mode, corresponding to a second operational mode of the wayside device, in which said first pattern of light is off and said second pattern of light is on.

13 Claims, 4 Drawing Sheets

SYSTEM, METHOD AND DEVICE FOR CONVEYING INFORMATION FROM A WAYSIDE DEVICE

FIELD

Embodiments of the invention relate to communications using non-visible light. Other embodiments relate to communications from wayside devices to off-highway vehicles such as trains.

BACKGROUND

The operational mode of wayside devices typically is communicated to the crews of the rail vehicle visually. As an example, rail switches typically indicate their configuration or a fault state through the use of a mechanical flag or illumination of a visible light. Consequently, the operator of the rail vehicle typically will not know the configuration of the wayside device until the rail vehicle is close enough to the wayside device to permit the crew to view the indicator. This can be problematic at night or in inclement weather, such as fog or heavy rain, which can reduce visibility. What is needed is a means to communicate the operational mode of a wayside device that is not obstructed by poor visibility and that allows the crew of the rail vehicle and/or the rail vehicle safety system to receive the communication further from wayside device than some visual indicators. Some embodiments of the present invention may provide these and/or other features.

BRIEF DESCRIPTION

Embodiments of the present invention may comprise a system, method and device for communicating information from a wayside device to a vehicle. In one embodiment, the device comprises. a first light unit configured to emit a first pattern of light in a non-visible spectrum; a second light unit configured to emit a second pattern of light in the non-visible spectrum; wherein said first pattern is distinct from said second pattern; an interface in communication with the first and second light units and configured to receive information of an operational mode of the wayside device; wherein the first and second light units are responsive to one or more first control signals from said interface to operate in a first mode, corresponding to a first operational mode of the wayside device, in which said first pattern of light is on and said second pattern of light is off; and wherein the first and second light units are responsive to one or more second control signals from said interface to operate in a second mode, corresponding to a second operational mode of the wayside device, in which said first pattern of light is off and said second pattern of light is on.

In another embodiment, a system comprises a camera configured to capture images in a non-visible spectrum; an image module for operable coupling with the vehicle and configured to receive data of captured images from said camera; said image module configured to process data of captured images to identify images having a first pattern of non-visible light and a second pattern of non-visible light; said image module configured to output a first message indicative of a first operational mode of the wayside device in response to identifying one or more images having the first pattern of non-visible light; and said image module configured to output a second message indicative of a second operational mode of the wayside device in response to identifying one or more images having the second pattern of non-visible light.

In yet another embodiment, a method may comprise receiving a first pattern of non-visible light at the vehicle that is indicative of a first operational mode of the wayside device; distinguishing the received first pattern of non-visible light from a plurality of patterns of non-visible light; and based on the received first pattern of non-visible light, outputting a first message indicative of the first operational mode of the wayside device.

In still another embodiment, a device comprises a first light unit configured to emit a first pattern of light in a non-visible spectrum; a second light unit configured to emit a second pattern of light in the non-visible spectrum; and wherein said first pattern is distinct from said second pattern.

BRIEF DESCRIPTION OF THE DRAWINGS

The present invention will be better understood from reading the following description of non-limiting embodiments, with reference to the attached drawings, wherein below.

DETAILED DESCRIPTION

As used herein, "off-highway vehicle" refers to various classes of commercial vehicles that are not designated for general use on automobile roadways. Examples include trains (or other rail vehicle consists or other rail vehicles), marine vessels, agricultural vehicles, mining vehicles (e.g., 100+ ton haul trucks), and construction equipment. The term "consist" is meant to refer to a group of vehicles mechanically linked to travel together along a route. Thus, the term "consist" may be applicable when referring to various types of systems including, but not limited to, marine vessels, and other off-highway vehicles such as agricultural vehicles, mining vehicles, trains, and/or construction equipment that operate together so as to provide propulsion and/or braking capability. Therefore, even though the term rail vehicle consist is used herein in regards to certain illustrative embodiments, the term "consist" may also apply to other powered systems. In addition, as used herein the term "rail vehicle consist" is meant to include any and all rail vehicles such as, for example, trains and mining carts. As used herein, in the context of rail vehicles, track and route are considered having the same meaning since a track defines a route taken by a rail vehicle. As used herein, a rail vehicle may comprise a powered rail vehicle such as a locomotive (meaning capable of self-propulsion) or a non-powered rail vehicle such as a rail car (meaning incapable of self-propulsion).

Embodiments of the present invention include a communication device to communicate one or more patterns of non-visible light from a wayside device to the rail vehicle or other off-highway vehicle. ("Wayside" means along a route of the vehicle.) Each pattern of non-visible light may correspond to and indicate a different operational mode of the wayside device (e.g., fault, left turn, right turn, straight, or the like). In one example embodiment, the communication device located at or near the wayside device comprises three lights. Each light includes a group of infrared light emitting diodes (LEDs). Each group of infrared LEDs is arranged in a pattern that is distinct from the patterns of the other groups of infrared LEDs. The rail vehicle or other off-highway vehicle may comprise a camera configured to capture infrared images and a processor to receive the captured infrared images. The processor is also configured to distinguish between the different patterns of infrared light and, based on the identified pattern, to output an indication of the operational mode of the wayside device to inform the train (or other vehicle) crew and/or a train (or other vehicle) safety system (e.g., a PTC system). The crew and/or the train (or other vehicle) safety system may analyze the operational mode of the wayside device and, if warranted, take appropriate action such as braking and/or stopping the train or other vehicle.

Figure 1:
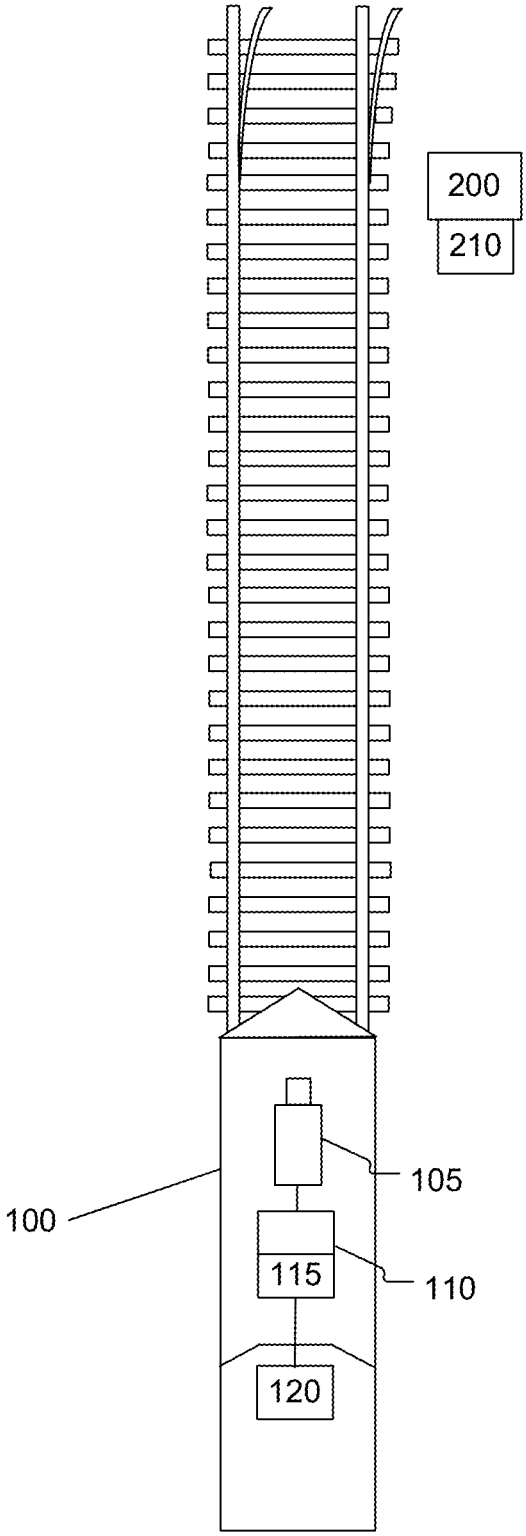
FIG. 1 depicts an example of a rail vehicle consist in accordance with an example embodiment of the present invention.

FIG. 1 depicts an example of a rail vehicle or other off-highway vehicle 100 and a communication device 210 for implementing some embodiments of the present invention, as part of a system for communicating information from a wayside device to an off-highway vehicle or otherwise. The communication device 210 is associated with, and in communication with, a wayside device 200. The communication device 210 is configured to emit a non-visible light pattern that is indicative of the operational mode of the wayside device 200. The communication device 210 may be attached to, or integrated with, the wayside device 200.

As part of the system, the off-highway vehicle 100 may be provided with a camera 105 and an image module 110. The non-visible light pattern from the communication device 210 is captured by the camera 105, which is configured to capture light in the spectrum of the non-visible light emitted by the communication device 210. The camera 105 may comprise a video camera or a still camera that takes a series still images.

The captured images are output from the camera 105 to the image module 110, which is operably coupled with the camera 105. The image module 110 may be a processor-based device, either stand-alone or part of or otherwise integrated with the camera 105. Alternatively, the image module may be implemented on an existing system of the off-highway vehicle 100. (For example, the image module 110 could comprise a set of program instructions, stored on tangible non-transitory media accessible to a vehicle controller or other processor-based device on-board the vehicle, that when executed by the processor-based device causes the processor-based device to perform one or more of the functional aspects of the image module described herein.) Still further, the image module 110 may include distributed functionality across two or more different systems/sub-systems. The image module 110 is configured to process the captured images to identify the pattern(s) of non-visible light emitted by the communication device 210. Thus, the image module 110 distinguishes between the different patterns of non-visible light that can be emitted by the communication device 210.

The image module 110 is configured to output a notification indicative of the operational mode of the wayside device 200 in response to processing the captured image. The notification may be received by a user interface in order to notify train personnel and/or may be received by a train safety system 120 (e.g., PTC), which may respond to the notification by taking action such as by braking the train.

Figure 2:
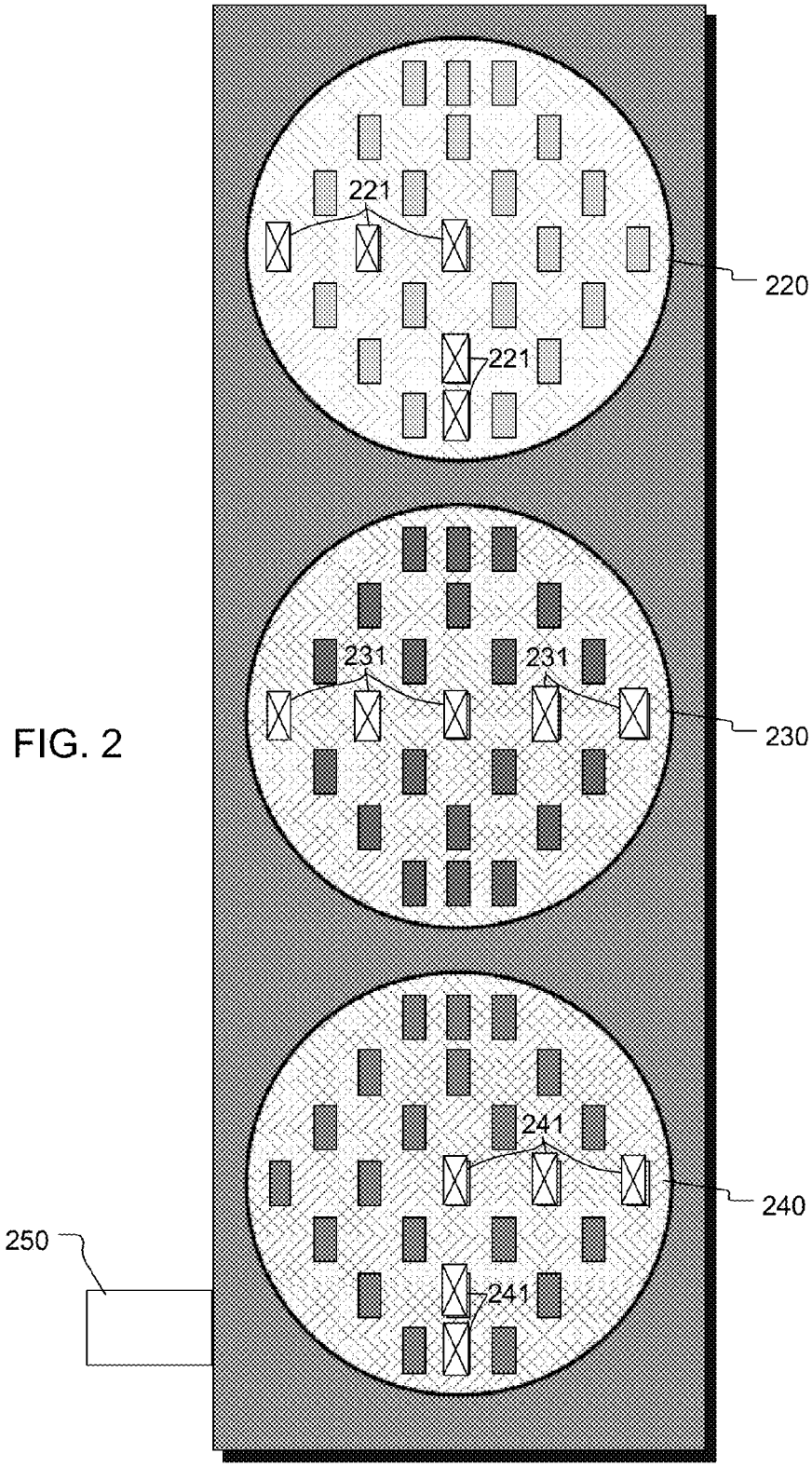
FIG. 2 depicts an example of a communication device in accordance with an example embodiment of the present invention.

FIG. 2 illustrates an example embodiment of a communication device 210. This example device 210 is comprised of three light units 220, 230 and 240. Each light unit 220, 230 and 240 is formed of a plurality of light emitting diodes (LEDs)—indicated by the rectangles—some of which are configured to emit light in a non-visible spectrum. Specifically, in FIG. 2 the rectangles with an "x" inside represent LEDs configured to emit light in a non-visible spectrum, which in this embodiment comprises infrared light. The rectangles without an "x" in side in the figure represent LEDs configured to emit light in the visible spectrum The first light unit 220 is comprised of five LEDs 221 that are configured to emit infrared light (as noted above, represented in FIG. 2 by rectangles with an "x"). The other LEDs of the first light unit 220 (represented in FIG. 2 by rectangles without an "x") are configured to emit visible light, such as emitting green light. The second light unit 230 also is comprised of five LEDs 231 configured to emit infrared light. The other LEDs of the second light unit 230 (represented in FIG. 2 by rectangles without an "x") are configured to emit visible light, such as emitting red light. The third light unit 240 is comprised of five LEDs 241 configured to emit infrared light. The other LEDs of the second light unit 240 (represented in FIG. 2 by rectangles without an "x") are configured to emit visible light, such as by emitting orange light.

As is evident from FIG. 2, the infrared LEDs 221 of the first light unit 220 are arranged in a first pattern, the infrared LEDs 231 of the second light unit 230 are arranged in a second pattern, and the infrared LEDs 241 of the third light unit 240 are arranged in a third pattern. In this embodiment, the patterns are all different and distinct from one another.

The communication device 210 also may include an interface 250 for receiving information indicative of the operational mode of the wayside device that is operably coupled to the light units 220, 230, 240. The interface 250 may include mechanical, electrical, and/or logic circuitry and be configured to output the one or more control signals to cause one or more of the light units (or sub-group of LEDs of the light unit) to illuminate in response to receiving information of the operational mode of the wayside device 200. In certain embodiments, the interface 250 may simply comprise a connector. In one example embodiment, the communication device 210 may be integrated with, or connected to, a wayside switch, which may have three operational modes. In this example embodiment, a first operational mode of the switch corresponds to a first switch configuration (or alignment) in which the rail vehicle would travel straight and (further) along a first track. In a second operational mode the switch may be in a second configuration in which the rail vehicle would turn and travel along a second track. In a third operational mode the switch may have failed and be in a fault condition.

The Information from the switch or other wayside device indicating the operational mode is conveyed to the communication device 210, such as via interface 250, to cause at least one of the three light units 220, 230 or 240 to illuminate. In this example embodiment, if information from the wayside switch indicates the switch is operating in the first operational mode (i.e., the first configuration causing the train to go straight), the first light unit 220 is illuminated (including the infrared LEDs 221 and the visible light LEDs). If information from the wayside switch indicates the switch is operating in the second operational mode (i.e., the second configuration causing the train to turn), the second light unit 230 is illuminated (including the infrared LEDs 231 and the visible light LEDs). If information from the wayside switch indicates the switch is operating in the third operational mode (i.e., the switch is in a fault condition), the third light unit 240 is illuminated (including the infrared LEDs 241 and the visible light LEDs). Thus, when each light unit is lit, the light unit emits light in the visible spectrum (and of a particular color) and in a non-visible spectrum (e.g., infrared). Thus, in some embodiments the non-visible light may be supplemental to the light emitted in the visible spectrum.

As is evident from FIG. 2, in this example embodiment each light unit includes a group of five infrared LEDs arranged in a pattern that is distinct from the pattern of the infrared LEDs of the other groups of LEDs of the other light units. Furthermore, it is worth noting that while each group of infrared LEDs is comprised of five infrared LEDs, the pattern emitted by any four infrared LEDs of any group is distinct from the pattern of any four infrared LEDs of any other group. Thus, in this example embodiment the pattern of non-visible light emitted by five subsets (any set of four infrared LEDs) of each group of infrared LEDs is distinct from the pattern of non-visible light emitted by five subsets of infrared LEDs of every other group of infrared LEDs. Consequently, the pattern of non-visible light emitted by a plurality of subsets of each group of infrared LEDs (five subsets in this example) is distinct from the pattern of non-visible light emitted by a plurality of subsets of each other group of infrared LEDs. Thus, if one infrared LED in the group of infrared LEDs of each light unit where to fail (or be obstructed) the pattern of infrared light of each group would still be distinct from the pattern emitted by the other groups regardless of which infrared LED in any group where to fail (or be obstructed). Alternately, the pattern of non-visible light emitted by each light unit remains distinct from the other patterns even if a portion of each of the patterns were not received (e.g., one or more of the infrared LEDs fail or are obstructed).

The communication device 210 may include a power supply and be powered from either 220V source or a 120V source. In addition, the communication device 210 may include one or more supplemental power sources such as a battery, a solar energy source (e.g., panel and/or cell), to supply power in the event of a power outage (i.e., loss of primary power). The interface 250 may receive the information via wireless signals, electrically (conductive) signals, and/or mechanical signals.

The camera 105 may comprise a video camera or a still image camera (or a camera that can take both video and still images) configured to capture light in the non-visible spectrum that is emitted by the light unit(s) of the communication device 210, which in this example embodiment is infrared light. Image data of the non-visible light pattern from the communication device 210 captured by the camera 105 is output to the image module 110 through any suitable medium including, for example, wirelessly, or via wired connection (conductive, fiber optic, etc.). The camera 105 may be attached to the rail car (e.g., such as the lead locomotive) and angled to capture communication devices 210 on either or both sides of the track (or route). Some embodiments may include two cameras—each focused on an opposing side of the track (and in communication with the same or different image modules 110).

Image module 110 may comprise one or more processor based computer systems, which may be co-located (in the same housing or rail car) or may be remote from each other (e.g., in different rail cars). Each computer system may have its own memory 115 including transitory and non-transitory memory (or may share memory with other computer systems) storing a plurality of patterns and corresponding codes indicating associated operational modes, various configuration data, and one or more executable algorithms that, for example, are executed to perform the image processing of the captured images The image module 110 processes the image data received from the camera 105 and distinguishes between the different patterns of non-visible light that can be emitted by the communication device 210. Specifically, a memory 115 of the image module 110 may store data of a plurality of different patterns (of non-visible light) that may be emitted by a plurality (e.g., dozens) of wayside devices. Thus, while a given communication device 210 might be capable of emitting only two, three or four different non-visible patterns, the plurality of communication devices that may be installed on the rail system may collectively be able emit dozens of different non-visible patterns that may be distinguishable and recognizable by some embodiments.

In one embodiment, each pattern stored in memory may be unique and distinguishable from the other stored patterns and therefore represent a unique operational mode. In addition, the memory may store a message, such as unique code, that is representative of the operational mode of the wayside device that corresponds to each non-visible light pattern stored in memory. Table I below depicts infrared patterns A-F, a corresponding code, and a description of the corresponding operational mode.

TABLE I

| Pattern | Code | Operational Mode Description |
|---|---|---|
| A—square | 001 | Switch Fault |
| B—triangle | 002 | Switch Turn to Left |
| C—diamond | 003 | Switch Turn to Right |
| D—L shape | 004 | Switch Configured to Straight |
| E—F shape | 005 | Rail road yard open |
| F—X shape | 006 | Rail road yard closed |

Thus, as is evident from the table a non-visible light pattern may convey both the type of wayside device 200 (e.g., switch, rail road yard, etc.) as well as the operational mode of the wayside device 200. Various other shapes and codes, corresponding to the above operational modes or other operational modes also may be implemented.

The image module 110 may continuously receive and process the image data as the train 100 or other off-highway vehicle approaches the wayside device 200 and communication device 210. In one example embodiment, the image module 110 may compare the image data of the non-visible light pattern received from the camera 105 with the image data of each (or some) of the non-visible light patterns stored in memory 115. Upon determining that the image data of a non-visible light pattern received from the camera 105 satisfies a predetermined similarity threshold with the image of a non-visible light pattern stored in memory 115, a "match" is determined and a message, such as a code corresponding to the operational mode that corresponds to image of the pattern stored in memory 115 (that matches the pattern from the camera) may be retrieved and output and/or the code stored (or flagged) in (volatile and/or non-volatile) memory.

In order to ensure the accurate processing of images, the image module 110 may perform redundant processing. For example, the code (corresponding to the pattern and operational mode of the wayside device 200) may only be output after processing of three consecutive images (or three images taken at least one half second apart) results in the same code. To perform such redundant processing, the code corresponding to each processed image may be stored in memory and compared with the two (or three or some other number of) previously stored codes to ensure the accuracy of the processing. If the code of a newly processed image is the same as the previously stored codes, the code is output (or continues to be output). If the code is not the same, the code is not output (or is no longer output) and a default code may be output indicating that received pattern is not being adequately received to provide a reliable operational mode (or to indicate another default scenario). In other embodiments, a code from a processed image may be compared with codes of two, four, five, or more codes of most recently processed images. Furthermore, the processing of images may additionally or alternately be bound by a predetermined time duration or location (e.g., distance from the wayside device 200 or another wayside device 200). For example, images may be processed for two seconds and, if the processing of a predetermined percentage of images results in the same code (e.g., as well as the last image), the code may be output. Various methods of redundant processing may be employed depending on the embodiment.

In order to reduce the likelihood that the camera 105 inadvertently captures the non-visible light emitted by light units of different communication devices 210 (and the image module 110 processes such images), the capturing of images by the camera 105 and/or the processing of captured images by the image module 110 may be temporarily disabled at particular locations (such as segments of track at which images from more than one communication device 210 may be captured by the camera 105) and/or after successfully processing (including redundantly processing) of a non-visible light pattern from a communication device 210 (for a predetermined time period). The location of the rail vehicle or other off-highway vehicle may be determined via a location system such as GPS receiver system. Alternately or additionally, the image module 110 may be configured to discard images that include more than one pattern of non-visible light.

In some instances, the light unit that is lit may change as the train 100 approaches the wayside device 200. If after a first pattern is detected and corresponding first code is output, a new pattern is detected and redundantly processed (e.g., detected three times), the new code may be output instead of the first code to indicate to the crew and/or the train safety system that the operational mode of the wayside device 200 has changed.

The train safety system 120 may receive the code, indicating the operational mode of the wayside device 200, from the image module 110 and, depending on the code, may take (e.g., immediate) action such as by braking or stopping the train to avoid derailment and/or a collision. More specifically, the train safety system 120 (or the safety system of the other off-highway vehicle) may process one or more operational parameters (e.g., the speed, train, location (distance to wayside device), weight of the train, etc.) in conjunction with the received code (indicating a particular operational mode of the wayside device 200) to determine whether the operational mode of the wayside device 200 warrants an immediate action (or any action) under the current operational parameters (and if so, performs one or more processes to initiate the warranted action(s)).

Figure 3:
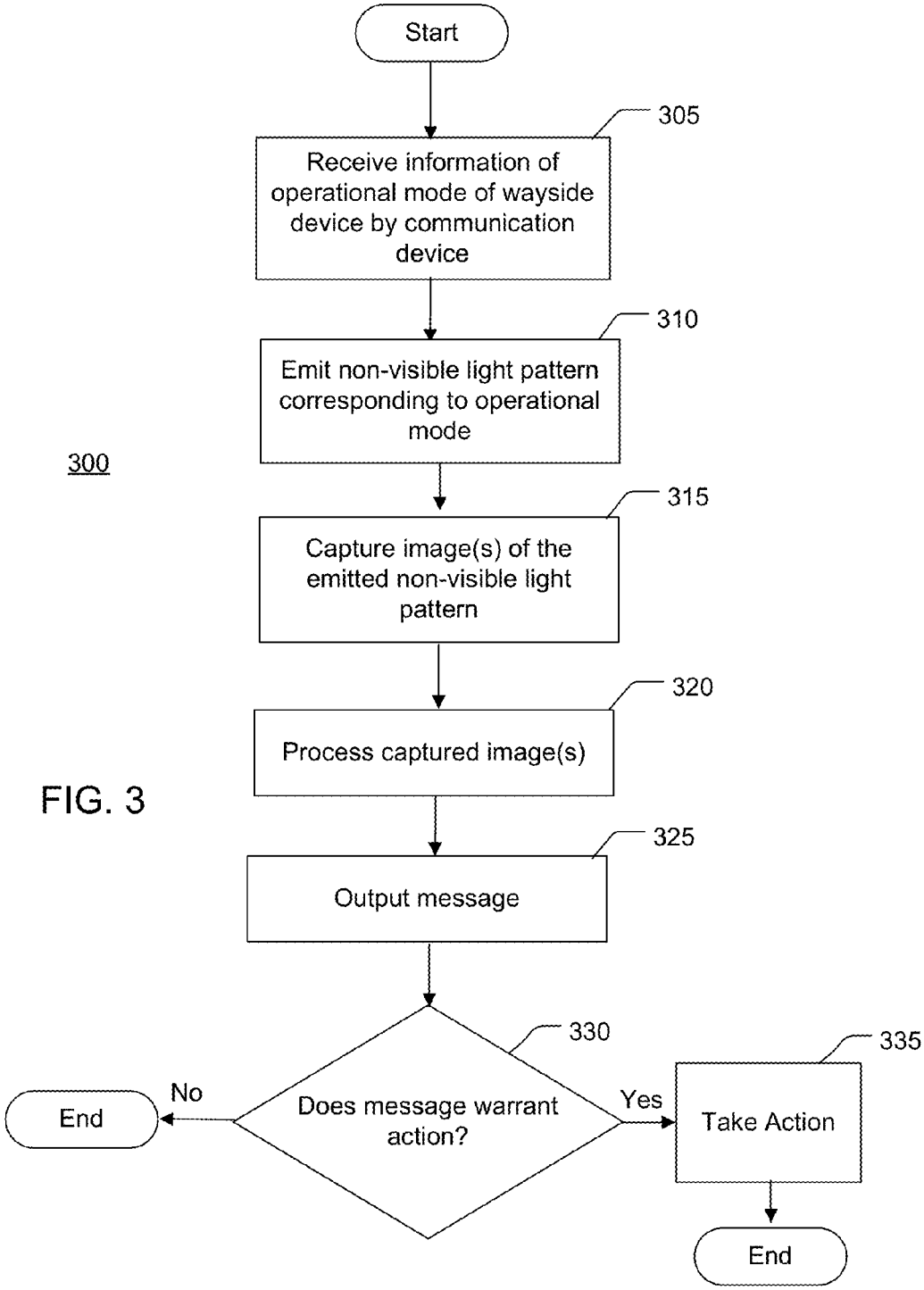
FIG. 3 illustrates a method of implementing an example embodiment of the present invention.

FIG. 3 illustrates a method 300 of implementing the present invention according to an example embodiment. At 305 the process 300 includes receiving information of the operational mode of the wayside device 200 at the communication device 210. As discussed, the information may be received mechanically, electrically, wirelessly and/or via any suitable manner. In some embodiments, the received information may be converted, translated, formatted, and/or otherwise used by the interface 250 to determine (if necessary) which light unit to light and to output one or more control signals to one or more light units. In some embodiments, the interface may simply conduct a control signal from the wayside device to one or more of the light units. In other embodiments, information from the wayside device 200 may be processed via logic of the interface 250 to determine which control signal(s) to output to which light unit(s). At 310 the process includes emitting a non-visible light pattern that corresponds to the operational mode of the wayside device 200. In one example embodiment, this includes illuminating a plurality of infrared LEDs as well as a plurality of LEDs that emit light in the visible spectrum in a particular color. In other embodiments, LEDs that emit light in the visible spectrum may not be illuminated. At 315 the process 300 includes capturing one or more images of the emitted non-visible light pattern such as by a camera 105 attached to the rail vehicle 100. The captured images may also be stored in memory.

At 320 the process 300 includes processing the one or more captured images. For example, the captured images may be processed to determine whether the image satisfies a predetermined similarity threshold with one of one or more image of patterns stored in memory. In addition, the processing may comprise redundant processing as described herein. At 320 the process includes outputting a message based on the processing. In some instances, the message may comprise a default notification that indicates the one or more captured images do not represent a valid pattern. For example, if the train or other off-highway vehicle is too far from the communication device 210 to capture any images, the processing may determine that the captured image does not satisfy a similarity threshold with any image stored in memory. Alternately, if the captured image does satisfy a similarity threshold with an image stored in memory, a message that may comprise a code corresponding to the image (and operational mode) may be output at 325. It is worth noting that various image processing may be performed, including some that do not perform the process of determining whether the captured image satisfies a similarity threshold with an image stored in memory. At 330 the process 300 may include determining whether the message (and the corresponding operational mode of the wayside device 200) warrants taking action based on one or more operational parameters of the train or other off-highway vehicle. If not, the process ends. If the message warrants taking action, the process includes taking action, such as by braking (reducing the speed) or stopping the train or other off-highway vehicle, at 335. For example if a switch's configuration is not as anticipated (determined by comparing the configuration indicated by the message with an anticipated configuration stored in memory), or if the pattern indicates a fault condition for the switch, the train safety system may stop the train.

The process 300 as whole may repeat continuously and the End labels are for ease of explanation of one cycle. In addition, many of the individual processes may be ongoing and in parallel with other individual processes. For example, at 305 the communication device 210 may continuously receive information of the operational mode of the wayside device 200 (e.g., receive the switch configuration of the wayside switch). Likewise, in some embodiments the communication device 210 may continuously emit the non-visible light pattern corresponding to the operational mode (at 310), the camera 105 may continuously capture images (at 315), and the image module 110 may continuously process images and output a notification (at 320). Likewise the train safety system 120 may continuously evaluate the message(s) to determine whether action is warranted (at 330).

In some embodiments, the technical effect is that the operational mode of wayside equipment may be detected at a greater distance from the wayside device and/or in conditions of poor visibility thereby reducing the likelihood of train collision and/or derailment.

While the description above refers to rail switches, other wayside devices with which embodiments of the present invention may be employed include rail road yard (e.g., rail road yard lights). While the example embodiment described above includes three light units, other embodiments may include one light unit, two light units, four light units, or another number of light units (each having a set of non-visible LEDs). While the example described above includes infrared LEDs and LEDs that emit light in the visible spectrum, other embodiments may employ other types of light sources (other than LEDs).

While in the embodiment above, each light unit (and its integrated pattern of infrared LEDs) corresponds to a particular operational mode, in other embodiments one or more combinations of non-visible light emitting LEDs of different light units may additionally, or alternately, correspond to one or more operational modes. For example, the pattern of the infrared LEDs emitted by a first light unit may indicate a first operational mode (e.g., a first switch configuration-straight), the pattern of the infrared LEDs emitted by a second light unit may indicate a second operational mode (e.g., a second switch configuration—turn right), the pattern of the infrared LEDs emitted by both the first and second light unit (which are illuminated concurrently) may indicate a third operational mode (e.g., a switch fault).

Figure 4:
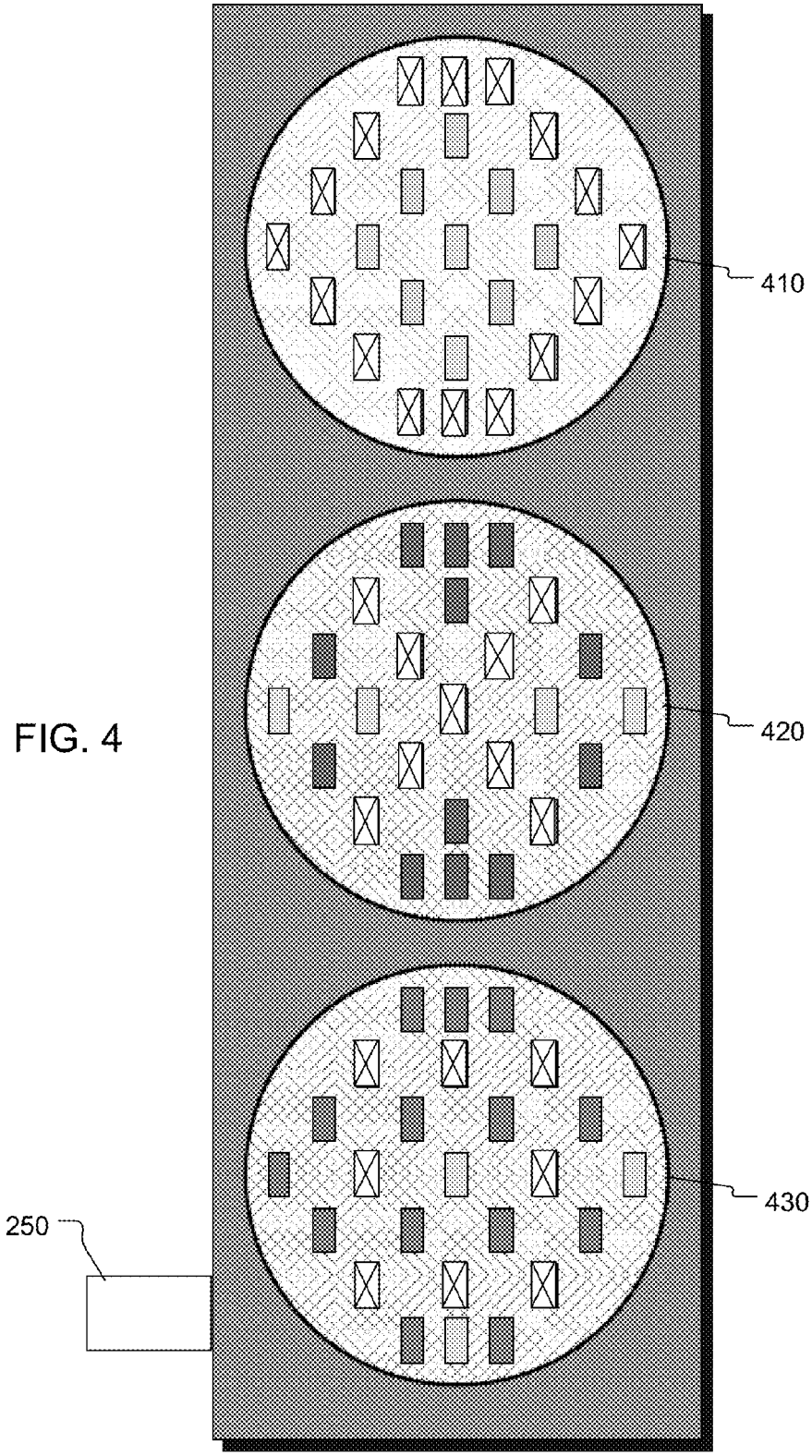
FIG. 4 depicts another example of a communication device in accordance with an example embodiment of the present invention.

While FIG. 2 depicts an example of a communication device 210 in accordance with an example embodiment, FIG. 4 provides another example embodiment. As is illustrated, the LEDs configured to emit light in the non-visible spectrum (represented by rectangles that include an "X" inside) are formed in a generally diamond pattern in a first light unit 410, are formed in a generally "X" pattern in a second light unit 420, and formed in a generally square (or rectangular) pattern in a third light unit 430. Those rectangles without an X in each light unit represent LEDs configured to emit light in a visible spectrum. Other embodiments may include numerous variations on the number of light units, the arrangement of the light units (e.g., horizontal versus vertical alignment), the arrangement of the non-visible light sources (e.g., LEDs), the number of non-visible light sources, and various other characteristics. Some embodiments may include a single light unit that includes multiple distinct patterns of non-visible light sources and where each pattern corresponds to a different operational mode of the associated wayside device and is illuminated accordingly.

In some embodiments, the same non-visible LEDs may be lit for each operational mode, but some or all of the non-visible light LEDs may be physically moved in location to correspond to different operational modes of the wayside device 200. For example, light unit 220 of FIG. 1 may be rotated to be in any one of four positions (each position being ninety degrees apart) to provide any of four non-visible light patterns using a single light unit 220. Alternately, light 220 of FIG. 1 may be rotated between two positions, one hundred eighty degrees apart, to facilitate two non-visible light patterns using a single light unit 220.

Particular configurations of the LEDs (or other light sources) that produce each pattern may be chosen based on various considerations including, for example, a signal-to-noise ratio associated with each pattern (e.g., choosing patterns that have higher signal-to-noise ratios or signal-to-noise ratios above a threshold).

In the embodiments described herein, the non-visible patterns of light comprise information that is supplemental to the information conveyed via visible light. In other embodiments, the non-visible light sources (e.g., LEDs) are not part of a light unit that also emits visible light (although other visual communication may be used such as a mechanical flag).

Communication devices 210 of some embodiments of the present invention may be attached to pre-existing wayside devices 200 already in use and/or may form part of newly manufactured wayside devices 200. Likewise, a camera 105 for practicing some embodiments may be designed to capture images in the visible light spectrum (e.g., to record travels) and therefore may have uses additional to capturing non-visible light patterns. While the camera 105 and image module 110 of the above described embodiments are located in the lead locomotive, they may be located anywhere in the rail vehicle consist that permits (by the camera 105) suitable communication (e.g., line of sight) with wayside devices. Depending on the embodiment, the image module 110, camera 105 and train safety system 120 all may be in the same or different rail cars of the rail vehicle consist. While the above embodiment describes a message that may comprise a code, the message may comprise any information suitable to convey the desired information.

While the above described embodiments are described in the context of a train, embodiments also may be implemented for other rail vehicles (mining carts), other OHVs (off-highway vehicles), or other vehicles. Certain embodiments, such as embodiments for use with wayside switches, are useful for trains and other rail vehicles.

The description above refers to LEDs emitting non-visible light (e.g., infrared) and LEDs emitting light in a visible spectrum. Some LEDs may be designed to emit both visible light and non-visible (e.g., infrared) light. In addition, LEDs designed to emit light in a visible spectrum may also radiate heat and therefore emit light in a non-visible light. Consequently, some embodiments of the present invention may utilize different patterns of non-visible light representing different operational modes that are distinct from each other—regardless as to whether the non-visible light source(s) also emit(s) visible light and/or whether any other visible light sources also emit non-visible light. While the description above describes groups of infrared LEDs forming parts of different light units, in other embodiments different groups of infrared LEDs (or other non-visible light sources) may form a single light unit.

While the description above refers to groups of LEDs emitting one of plurality of patterns, some embodiments may display a pattern temporally (over time). More specifically, one or more non-visible light units may flash in a particular pattern that corresponds to the operational mode of the wayside device 200. The communication protocol for the flashing may comprise any suitable communication protocol such as, for example, wherein combinations of different durations of flashes correspond to different wayside device operational modes. Furthermore, the communication protocol may be designed to communicate ASCII (American Standard Code for Information Interchange) characters (and may further be designed to spell out the operational mode of the wayside device 200 or a message, such as a code, corresponding to the operational mode). A pattern (e.g., ASCII or otherwise) to be emitted through flashing may be repeatedly flashed on an ongoing basis to allow the camera 105 to capture and the image module 110 to process the emitted pattern.

In one embodiment, the device comprises. a first light unit configured to emit a first pattern of light in a non-visible spectrum; a second light unit configured to emit a second pattern of light in the non-visible spectrum; wherein said first pattern is distinct from said second pattern; an interface in communication with the first and second light units and configured to receive information of an operational mode of the wayside device; wherein the first and second light units are responsive to one or more first control signals from said interface to operate in a first mode, corresponding to a first operational mode of the wayside device, in which said first pattern of light is on and said second pattern of light is off; and wherein the first and second light units are responsive to one or more second control signals from said interface to operate in a second mode, corresponding to a second operational mode of the wayside device, in which said first pattern of light is off and said second pattern of light is on. The non-visible spectrum comprises at least a portion of the infrared spectrum. The device may further comprise a third light unit configured to emit a third pattern of light in the non-visible spectrum; wherein said third pattern is distinct from said first pattern and said second pattern; said interface being in communication with said third light unit; wherein said third light unit is off in said first mode and in said second mode; and said first light, said second light and said third light are responsive to one or more third control signals to operate in a third mode, corresponding to a third operational mode of the wayside device, in which said first pattern of light is off, said second pattern of light is off, and said third pattern of light is on. The first pattern, second pattern, and third pattern may be configured to remain distinct from each other even if a portion of each pattern does not illuminate. The wayside device may comprise a switch and said first operational mode may comprise a first configuration of the switch and the second operational mode may comprise a second configuration of the switch. The non-visible spectrum comprises at least a portion of the infrared spectrum; the first light unit may comprise a first plurality of infrared LEDs arranged in the first pattern; and the second light unit may comprise a second plurality of infrared LEDs arranged in the second pattern and wherein a pattern of infrared light emitted by a plurality of subsets of the first plurality of infrared LEDs is distinct from a pattern of infrared light emitted by a plurality of subsets of the second plurality of infrared LEDs.

In another embodiment, a system comprises a camera configured to capture images in a non-visible spectrum; an image module for operable coupling with the vehicle and configured to receive data of captured images from said camera; said image module configured to process data of captured images to identify images having a first pattern of non-visible light and a second pattern of non-visible light; said image module configured to output a first message indicative of a first operational mode of the wayside device in response to identifying one or more images having the first pattern of non-visible light; and said image module configured to output a second message indicative of a second operational mode of the wayside device in response to identifying one or more images having the second pattern of non-visible light. The system may further comprise a memory storing the first and second messages; and wherein the first message and the second message are stored in association with data representative of the first and second patterns of non-visible light, respectively. The wayside device may comprise a switch and said first message corresponds to a first configuration of the switch and the second message corresponds to a second configuration of the switch. The non-visible light may comprise at least a portion of the infrared spectrum. The system may further comprise a safety system configured to receive the first message from said image module and to determine whether to brake the vehicle based, at least in part, on receipt of the first message and one or more operational parameters of the vehicle. The image module may be configured to perform redundant processing of data of captured images.

In yet another embodiment, a method may comprise receiving a first pattern of non-visible light at the vehicle that is indicative of a first operational mode of the wayside device; distinguishing the received first pattern of non-visible light from a plurality of patterns of non-visible light; and based on the received first pattern of non-visible light, outputting a first message indicative of the first operational mode of the wayside device. The method may further comprise receiving a second pattern of non-visible light at the vehicle that is indicative of a second operational mode of the wayside device; distinguishing the received second pattern of non-visible light from the plurality of patterns of non-visible light; and based on the received second pattern of non-visible light, outputting a second message indicative of the second operational mode of the wayside device. The wayside device may comprise a switch and said first operational mode comprises a first configuration of the switch and the second operational mode comprises a second configuration of the switch. The non-visible light may comprise at least a portion of the infrared spectrum. The method may further comprise storing in a memory of the vehicle a plurality of messages corresponding to operational modes for the wayside device, the plurality of messages including at least the first message and the second message; and wherein each message is stored in association with data representative of a different pattern of non-visible light. The method may further comprise determining whether to take an action based, at least in part, on said outputting the first message and one or more operational parameters of the vehicle.

In still another embodiment, a device comprises a first light unit configured to emit a first pattern of light in a non-visible spectrum; a second light unit configured to emit a second pattern of light in the non-visible spectrum; and wherein said first pattern is distinct from said second pattern. The device may further comprise a third light unit configured to emit a third pattern of light in the non-visible spectrum; and wherein said third pattern is distinct from said first pattern and said second pattern. The non-visible spectrum may comprise at least a portion of the infrared spectrum. The first light unit may be further configured to emit light of a first color in a visible spectrum; and the second light unit may be further configured to emit light of a second, different color in the visible spectrum. The first pattern and second pattern may be designed to remain distinct from each other even if a portion of each pattern does not illuminate. The non-visible spectrum may comprise at least a portion of the infrared spectrum; said first light unit may comprise a first plurality of infrared LEDs arranged in the first pattern; said second light unit may comprise a second plurality of infrared LEDs arranged in the second pattern; and wherein a pattern of infrared light emitted by a plurality of subsets of the first plurality of infrared LEDs is distinct from a pattern of infrared light emitted by a plurality of subsets of the second plurality of infrared LEDs.

In one embodiment, the method of communicating information from a wayside device to an off-highway vehicle, comprises outputting a first pattern of non-visible light indicative of a first operational mode of the wayside device; receiving the first pattern of non-visible light at the off-highway vehicle; distinguishing the received first pattern of non-visible light from a plurality of patterns of non-visible light; and based on the received first pattern of non-visible light, outputting a first message indicative of the first operational mode of the wayside device. The method may further comprise outputting a second pattern of non-visible light from the wayside device indicative of a second operational mode of the wayside device; receiving the second pattern of non-visible light at the off-highway vehicle; distinguishing the received second pattern of non-visible light from a plurality of patterns of non-visible light; and based on the received second pattern of non-visible light, outputting a second message indicative of the second operational mode of the wayside device. The wayside device may comprise a switch and said first operational mode may comprise a first configuration of the switch and the second operational mode may comprise a second configuration of the switch. The non-visible light may comprise at least a portion of the infrared spectrum. The method may further comprise storing in a memory of the off-highway vehicle a plurality of messages corresponding to operational modes for the wayside device; and wherein each message is stored in association with data representative of a different pattern of non-visible light. The method may further comprise determining whether to take an action based on the first message and one or more operational parameters of the off-highway vehicle, wherein the action comprises braking the off-highway the vehicle.

Another embodiment relates to a system for communicating information from a wayside device to a vehicle. The system comprises one or more light units. The system is configured for control of the lights units, in a first mode of operation (e.g., upon application of a first control signal(s)), for the one or more lights units to emit a first pattern of light in a non-visible spectrum, and in a second mode of operation (e.g., upon application of a second control signal(s)), for the one or more lights units to emit a second pattern of light in the non-visible spectrum or a different non-visible spectrum. The first pattern is distinct from said second pattern. In the modes, when one of the patterns of light is emitted, the other pattern of light may be off. In another embodiment, the system is part of a wayside switch or other wayside device, with the first and second modes of operation corresponding to different operational modes of the wayside device.

In another embodiment, one or more of the functional aspects of the light units as shown in the drawings may be integrated into a single light unit, such as within an array of LEDs disposed within a circular or rectangular delineating perimeter. For example, a light unit could comprise: a circular or square delineating perimeter; and an array of LEDs within the perimeter. A first plurality of the LEDs could be connected (logically or physically) for being commonly energized, to emit light in a first pattern (non-visible light or otherwise). A second, at least partially distinct plurality of the LEDs could be connected (logically or physically) for being commonly energized, to emit light in a second pattern (non-visible light or otherwise). In another embodiment, the array could also include: LEDs that emit visible light; or a first plurality of LEDs that emit visible light of one color, and a second, distinct plurality of LEDs that emit visible light of another, different color; or LEDs that can be controlled to emit light in one color and another, different color, depending on input voltage or otherwise; or the like. In one embodiment, a light unit could comprise a circular delineating perimeter, and an array of LEDs inside the perimeter, which array includes at least two groups of LEDs. The first group includes a first plurality of LEDs and a second, different plurality of LEDs, which are physically or logically linked for being commonly energized upon application of a designated control signal. The first plurality is configured to emit non-visible light in a first pattern, and the second plurality is configured to emit visible light of a first color. The second group includes a third plurality of LEDs and a fourth, different plurality of LEDs, which are physically or logically linked for being commonly energized upon application of a designated control signal. The third plurality is configured to emit non-visible light in a second, different pattern, and the fourth plurality is configured to emit visible light of a second color. Thus, upon application of a control signal for energizing the first group, a first color and first non-visible pattern are displayed (the second group is off), and upon application of a control signal for energizing the second group, a second color and second non-visible pattern are displayed (the first group is off). The light unit could include similar such groups, for displaying a third color and third non-visible pattern. The colors could be green and red, or green, red, and yellow/orange, for example. In another embodiment, the LEDs arrays for emitting non-visible light in first and second patterns could share at least some common members, with the different patterns being generated by controlling individual ones of the LEDs. In another embodiment, a light unit is as described in this section, but some of the LEDs are dual- or multi-mode, e.g., the groups could share the same LEDs for emitting visible light, but the LEDs for this purpose could be controlled to emit different colors of visible light, depending on the operational mode in question.

Another embodiment relates to a device for communicating information from a wayside device to a vehicle. The device comprises a first light unit configured to emit a first pattern of light in a non-visible spectrum, and a second light unit configured to emit a second pattern of light in the non-visible spectrum. The first pattern is distinct from the second pattern. The device further comprises an interface in communication with the first and second light units and configured to receive information of an operational mode of the wayside device. The device is responsive to receipt of first information from the wayside device indicative of a first operational mode of the wayside device to operate in a first mode in which the first pattern of light is on and the second pattern of light is off. Additionally, the device is responsive to receipt of second information from the wayside device indicative of a second operational mode of the wayside device to operate in a second mode in which the first pattern of light is off and the second pattern of light is on.

In another embodiment of a device with first and second light units, the first and second light units are further configured to each additionally emit visible light in different colors. Thus, a device may include a first light unit with a first non-visible light pattern and a first visible color, and a second light unit with a second non-visible light pattern (distinct from the first pattern) and a second, different visible color.

Although certain embodiments are illustrated herein in regards to LED's, such embodiments are also applicable (unless otherwise specified) to light emitting elements generally, referring to electric devices that emit light responsive to an applied voltage. In another aspect, such light emitting elements may be non-subdividable, meaning unable to be broken down without functional damage into smaller/other devices that emit light.

In an embodiment, the LED's or other light emitting elements emit light only in a contiguous bandwidth of the spectrum. In another embodiment, the light emitting elements are dual mode, meaning emitting light in two or more different, spaced-apart bandwidths. For example, emitting both visible light and non-visible light when energized (e.g., dual layer LED), or emitting visible light when a first voltage is applied and non-visible light when a second, different voltage is applied.

According to one aspect, emitting light in a non-visible spectrum means emitting light only in the non-visible spectrum, and/or that the light unit for emitting light in a non-visible spectrum is primarily purposed for this function, e.g., emitting non-visible light is the primary purpose of the device and not a byproduct or waste product, such as emitting heat energy consequential to emitting visible light.

In any of the embodiments set forth herein, light units may be configured to emit non-visible light in different non-visible light spectra, e.g., infrared and ultraviolet.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to one of ordinary skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments disclosed herein, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the disclosed subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described embodiments, without departing from the spirit and scope of the subject matter herein involved, it is intended that all of the subject matter of the above description or shown in the accompanying drawings shall be interpreted merely as examples illustrating the inventive concepts herein and shall not be construed as limiting the disclosed subject matter.

What is claimed is:

1. A system for communicating information from a wayside device to a vehicle, comprising:

a camera configured to capture images in a non-visible spectrum;

an image module for operable coupling with the vehicle and configured to receive data of captured images from said camera;

said image module configured to process data of captured images to identify images having a first pattern of non-visible light and a second pattern of non-visible light;

said image module configured to output a first message indicative of a first operational mode of the wayside device in response to identifying one or more images having the first pattern of non-visible light; and said image module configured to output a second message indicative of a second operational mode of the wayside device in response to identifying one or more images having the second pattern of non-visible light.

2. The system according to claim 1, further comprising a memory storing the first and second messages; and wherein the first message and the second message are stored in association with data representative of the first and second patterns of non-visible light, respectively.

3. The system according to claim 1, wherein the wayside device comprises a switch and said first message corresponds to a first configuration of the switch and the second message corresponds to a second configuration of the switch.

4. The system according to claim 1, wherein the non-visible light comprises at least a portion of the infrared spectrum.

5. The system according to claim 1, further comprising a safety system configured to receive the first message from said image module and to determine whether to brake the vehicle based, at least in part, on receipt of the first message and one or more operational parameters of the vehicle.

6. The system according to claim 1, wherein said image module is configured to perform redundant processing of data of captured images.

7. A method of communicating information from a wayside device to a vehicle, comprising:

receiving a first pattern of non-visible light at the vehicle that is indicative of a first operational mode of the wayside device;

at the vehicle, distinguishing the received first pattern of non-visible light from a plurality of patterns of non-visible light; and based on the received first pattern of non-visible light, at the vehicle, outputting a first message indicative of the first operational mode of the wayside device.

8. The method according to claim 7, further comprising:

receiving a second pattern of non-visible light at the vehicle that is indicative of a second operational mode of the wayside device;

distinguishing the received second pattern of non-visible light from the plurality of patterns of non-visible light; and based on the received second pattern of non-visible light, outputting a second message indicative of the second operational mode of the wayside device.

9. The method according to claim 8, wherein the wayside device comprises a switch and said first operational mode comprises a first configuration of the switch and the second operational mode comprises a second configuration of the switch.

10. The method according to claim 8, wherein the non-visible light comprises at least a portion of the infrared spectrum.

11. The method according to claim 8, further comprising storing in a memory of the vehicle a plurality of messages corresponding to operational modes for the wayside device, the plurality of messages including at least the first message and the second message; and wherein each message is stored in association with data representative of a different pattern of non-visible light.

12. The method according to claim 8, further comprising determining whether to take an action based, at least in part, on said outputting the first message and one or more operational parameters of the vehicle.

13. A method of communicating information from a wayside device to a vehicle, comprising:

receiving a first pattern of non-visible light at the vehicle that is indicative of a first operational mode of the wayside device;

distinguishing the received first pattern of non-visible light from a plurality of patterns of non-visible light; and based on the received first pattern of non-visible light, outputting a first message indicative of the first operational mode of the wayside device;

receiving a second pattern of non-visible light at the vehicle that is indicative of a second operational mode of the wayside device;

distinguishing the received second pattern of non-visible light from the plurality of patterns of non-visible light; and based on the received second pattern of non-visible light, outputting a second message indicative of the second operational mode of the wayside device; and determining whether to take an action based, at least in part, on said outputting the first message and one or more operational parameters of the vehicle;

wherein the action comprises braking the vehicle.

* * * * *